US007621832B2

(12) United States Patent
Morrow et al.

(10) Patent No.: US 7,621,832 B2
(45) **Date of Patent: *Nov. 24, 2009**

(54) HANDLE FOR A LACROSSE STICK

(75) Inventors: David Morrow, Metamora, MI (US); Andrew Maliszewski, Dearborn Heights, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/058,909

(22) Filed: Mar. 31, 2008

(65) Prior Publication Data

US 2008/0242453 A1 Oct. 2, 2008

Related U.S. Application Data

(63) Continuation of application No. 10/906,734, filed on Mar. 3, 2005, now Pat. No. 7,404,775.

(60) Provisional application No. 60/549,692, filed on Mar. 3, 2004.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

D5,178 S 8/1871 Gould
185,374 A 12/1876 Whitehouse
328,905 A 10/1885 Strasser et al.
D22,250 S 2/1893 Harsha
D22,271 S 3/1893 Ruxton
1,810,885 A 6/1931 Neuberth
1,839,919 A 1/1932 Hall
1,928,009 A 9/1933 Dornier
1,963,057 A 6/1934 Wilcox
2,237,969 A 4/1941 Olsen (Continued)

OTHER PUBLICATIONS

NPL Webpage download-jobshop-Mar. 27, 2009, Mark Shortt, The Anodizing Answer to Engineering Challenges ,2001, www.jobshop.com/techinfo/papers/anodizing_answer.shtml, 9 pages.*

(Continued)

*Primary Examiner*—Gene Kim
*Assistant Examiner*—M Chambers
(74) *Attorney, Agent, or Firm*—Warner Norcross & Judd LLP

(57) ABSTRACT

In one embodiment of the present invention, an improved handle (12) for a lacrosse head (16) is provided. The improved handle (12) includes a tubular member (20) having a top end (14) for attachment to the lacrosse head (16) and a bottom end (18) that is opposite to the top end (14). The tubular member (20) further includes an outer surface (22) having one or more predetermined portions (24) with a substantially hard coating (26) coupled thereto. The substantially hard coating (26) is utilized for strengthening the tubular member (20), preventing damage thereto, decreasing vibration therein, and providing the player with tactile stimuli as to the orientation of a lacrosse stick (10) within his hands.

15 Claims, 2 Drawing Sheets

U.S. PATENT DOCUMENTS

| | | | | |
|---|---|---|---|---|
| 3,697,069 | A * | 10/1972 | Merola | 473/566 |
| 3,702,702 | A | 11/1972 | Hoult | |
| 3,972,529 | A | 8/1976 | McNeil | |
| 4,037,841 | A | 7/1977 | Lewis, Jr. | |
| D245,756 | S | 9/1977 | McKee | |
| 4,206,918 | A | 6/1980 | Lewis, Jr. | |
| 4,233,834 | A | 11/1980 | Matinlassi | |
| 4,280,727 | A | 7/1981 | Germain | |
| 4,445,354 | A | 5/1984 | Pfeiffer et al. | |
| 4,739,994 | A | 4/1988 | Lewis, Jr. | |
| 5,048,843 | A | 9/1991 | Dorfi et al. | |
| 5,651,744 | A | 7/1997 | Millon et al. | |
| 5,749,798 | A | 5/1998 | Kuebler et al. | |
| 5,951,078 | A | 9/1999 | Whitehead et al. | |
| 6,235,134 | B1 | 5/2001 | Mueller | |
| 6,500,079 | B1 * | 12/2002 | Tucker, Sr. | 473/513 |
| 6,723,134 | B2 | 4/2004 | Tucker, Sr. | |
| 6,752,730 | B1 | 6/2004 | Brine, Jr. et al. | |
| 6,889,405 | B2 | 5/2005 | Ritrovato et al. | |
| 7,404,775 | B2 * | 7/2008 | Morrow et al. | 473/513 |

OTHER PUBLICATIONS

NPL,webpage download HauteStick, 2000, http://web.archive.org/web/20010224062601/www.hautestick.com/LaxGear/LaxShaft/HyperImpact/SM2-CIHI-SM2C- Info1.htm,9 pages.*
TI22, Lacrosse Handle—Brine.
Ignite, Lacrosse Handle—Brine.
Ignite Supra, Lacrosse Handle—Brine.
Triax, Lacrosse Handle—DeBeer.
CPSC Web Page, Jun. 1997, web page downloaded May 11, 2005, www.cpsc.gov/cpspub/prerel/prhtm197/97142.html, 1 page.
STX Lacrosse 2003 Equipment Apparel Catalog, 2 pages.
Brine 2000 Men and Women Catalog, 4 pages.

* cited by examiner

HANDLE FOR A LACROSSE STICK

CROSS-REFERENCE TO RELATED APPLICATION

This application is a continuation of U.S. application Ser. No. 10/906,734, filed on Mar. 3, 2005, now U.S. Pat. No. 7,404,775 entitled "Improved Handle For A Lacrosse Stick," the disclosure of which is incorporated by reference herein, which application claims the benefit of U.S. Provisional Application Ser. No. 60/549,692, filed on Mar. 3, 2004, and entitled "Lacrosse Handle With Improved Strength And Tactile Stimuli" which application is hereby incorporated by reference.

TECHNICAL FIELD

The present invention relates generally to a handle, and more particularly to a handle for a lacrosse head, which has a substantially lightweight and robust construction.

Lacrosse handles comprised of hollow metal tubes are well known. These metal handles were developed to replace prior wooden lacrosse handles, which were susceptible to damage from exposure to water and were relatively heavy and cumbersome. Typically, these metal tubes are comprised of aluminum, titanium, or other suitable strong lightweight alloys. In this way, typical lacrosse handles are beneficial for having a durable construction and enhancing a player's ability to manipulate and carry the handle. Furthermore, typical lacrosse handles have a generally symmetrical construction. However, more recently, handles for lacrosse heads have taken on other suitable shapes.

However, it is understood that the rigid metal construction can also transmit shock to a player's hands when the lacrosse stick is subjected to a sudden impact, e.g. slashing by an opponent. In addition, one skilled in the art will understand that the lightweight alloy can have scratches, dents, dings, or other damage somewhat easily formed thereon, particularly during play, such as when the lacrosse handle contacts another player's lacrosse handle or helmet. These kinds of damage can render the handle unplayable or merely unattractive. In these instances, the player must obtain a new handle, which can be relatively expensive or otherwise inconvenient. Tapes, wraps and the like have been utilized to protect the handles from damage during play. However, these all require the use of additional materials and increase the cost of the handle. Moreover, these handles have a generally uniform wall thickness thereby preventing the players from sensing the orientation of the handle based on the tactile feel of handle alone, i.e. without visual inspection.

Therefore, a need exists for a lacrosse handle having a substantially robust lightweight construction that provides tactile feedback regarding the orientation of the lacrosse stick in the player's hand such that a player can sense in what direction an attached lacrosse head is facing without the need for visual inspection.

SUMMARY OF THE INVENTION

It is therefore one advantage of the present invention to provide an improved handle for a lacrosse head with a substantially strong and lightweight construction.

It is another advantage of the present invention to provide a handle for a lacrosse head that absorbs shock that would otherwise be transferred to a player's hands.

It is yet another advantage of the present invention to provide a handle for a lacrosse head that includes corrosion-resistant capabilities.

It is still another advantage of the present invention to provide a handle for a lacrosse head that provides tactile feedback as to the orientation of the lacrosse head in the player's hands.

It is a further advantage of the present invention to provide a lacrosse handle that has increased resistance to dents and dings.

It is yet a further advantage of the present invention to provide a lacrosse handle with increased resistance to slippage or that has no-slip characteristics to provide a player with a better grip.

In accordance with the above and other advantages of the present invention, an improved handle for a lacrosse head is provided. The improved handle includes a tubular member having a top end for attachment to a lacrosse head and a bottom end that is opposite the top end. The tubular member further includes an outer surface having one or more predetermined portions with a coating coupled thereto. The coating is utilized for strengthening the tubular member, preventing damage thereto, and decreasing vibrations therein. Alternatively, the coating can provide the outer surface with a sticky or tacky feel.

Other advantages of the invention will become apparent when viewed in light of the detailed description in conjunction with the attached drawings and appended claims. Also, it is contemplated that the features, the functions, and the advantages can be achieved independently and in various embodiments of the present invention or may be combined in yet other embodiments.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Figure 1:
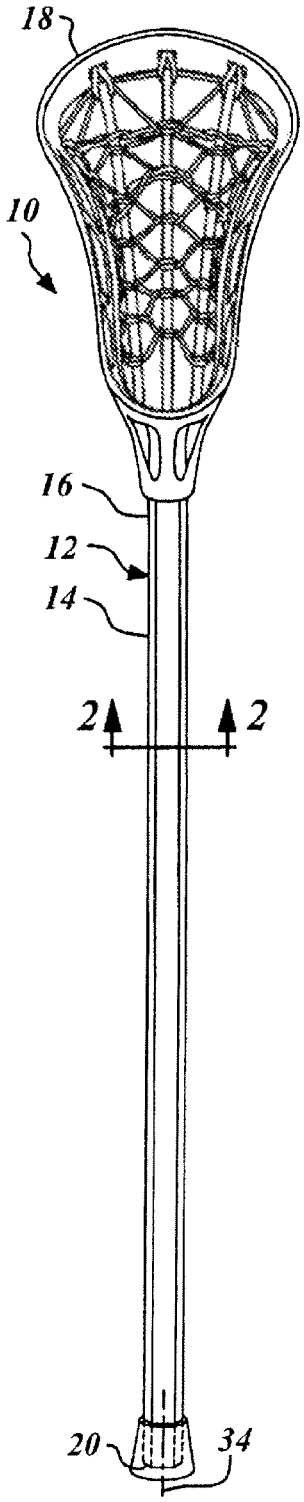
FIG. 1 is a top plan view of an improved handle for a lacrosse stick, according to one advantageous embodiment of the claimed invention.

In the following figures, the same reference numerals are used to identify the same or similar components in the various views.

The present invention is particularly suited for an improved handle for a lacrosse head. In this regard, the illustrated embodiments described herein employ features where the context permits, e.g. the lacrosse handle having a top end for attachment to a lacrosse head. However, it is contemplated that the handle can instead be utilized for various other devices, as well as other athletic endeavors, as desired. For that reason a variety of other embodiments are contemplated having different combinations of the described features, having features other than those described herein, or even lacking one or more of those features. It is therefore understood that the invention can be carried out in various other suitable modes. For example, the disclosed handle can be sued for ice hockey, field hockey, roller hockey, or the like.

Referring to FIG. 1, there is shown a lacrosse stick 10 having an improved handle 12, according to one advantageous embodiment of the claimed invention. The handle 12 includes a tubular member 14 having a top end 16 for attachment to a lacrosse head 18 and a bottom end 20 that is opposite the top end 16. In this embodiment, the handle 12 consists of the tubular member 14 preferably in the form of an extruded hollow metal tube. The tube can be constructed of aluminum or titanium material and is formed by an extrusion process. However, it will be appreciated that the tubular member 14 can instead be comprised of various other suitable materials and/or be produced by a variety of other suitable manufacturing processes. Moreover, the tubular member 14 can take on a variety of different shapes and lengths.

Figure 2:
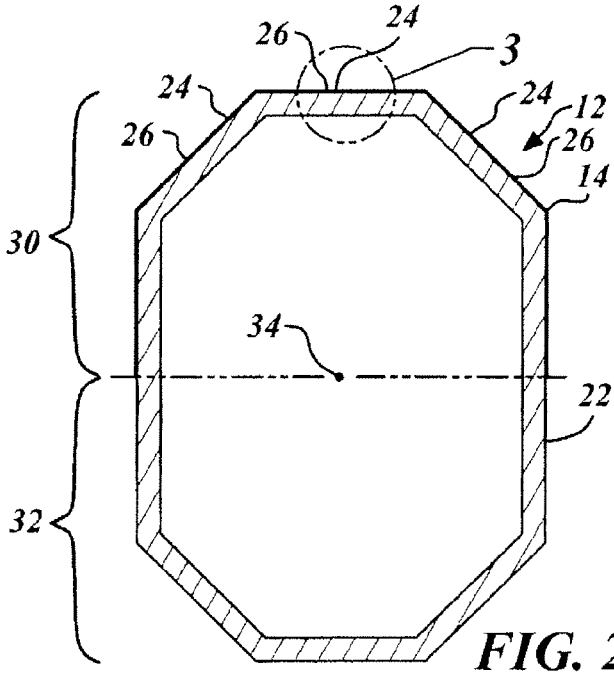
FIG. 2 is a cross-sectional view of the handle shown in FIG. 1 as taken along line 2-2.
Figure 3:
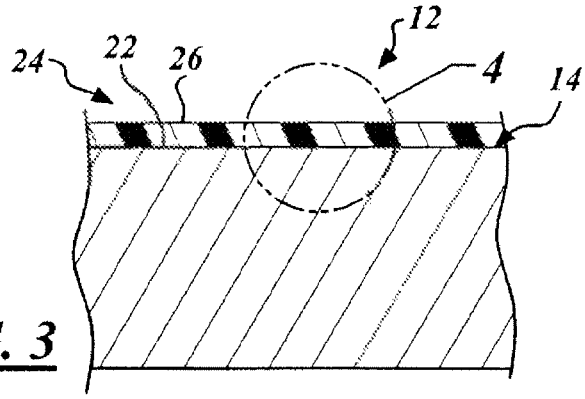
FIG. 3 is an enlarged view of the improved handle shown in FIG. 2 as taken within circle 3.
Figure 4:
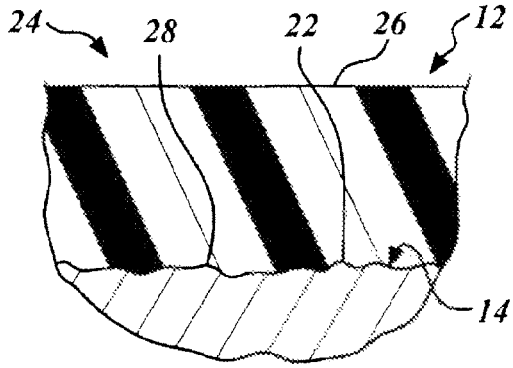
FIG. 4 is an enlarged view of the improved handle shown in FIG. 3 as taken within circle 4.

Furthermore, as shown in FIGS. 2-4, the tubular member 14 further includes an outer surface 22 having one or more predetermined portions 24 with a coating 26 coupled thereto. The coating 26 is beneficial for strengthening the tubular member 14 so as to minimize scratches, dents, dings, and/or other damage thereto. In addition, the coating 26 also is beneficial for maintaining a substantially lightweight construction of the handle 12. In one embodiment, the coating 26 consists of a substantially hard composition or material. However, a variety of other suitable compositions or materials may be utilized. In this embodiment, the tubular member 14 includes the predetermined portions 24 of the outer surface 22, which are intended to receive the coating 26. However, it will be understood that the coating 26 can be applied to the entire exterior surface 22 of the tubular member 14.

In one embodiment, prior to the application of the coating 26, the exterior or outer surface 22 of the handle 26 is pretreated. For example, the outer surface 22 of the handle 12 is subjected to a heavy grit blast, which reduces stress on the handle 12 and provides it with increased strength. The grit blast also raises the surface of the tubular member 14 such that it has a textured surface 28 (as shown in FIG. 4) instead of a smooth surface. Thereafter, the pretreated handle 12 has a hard coat anodize 26 placed thereon. As will be understood by one of ordinary skill in the art, this type of manufacturing process is a dense electro/chemical deposition of oxide that penetrates the outer skin of the handle 12, which leaves the hard-coat 26 on the outer surface 22. One skilled in the art will understand that the oxide layer is beneficial for preventing corrosion of the metal tubular member. One skilled in the art will also understand that the coating 26 provides a substantially smooth surface finish for easily sliding the handle 12 within a player's hand while the player passes or shoots the ball. However, it is contemplated that the coating 26 can be comprised of various other suitable materials as desired. Moreover, it is contemplated that the hard coat anodize 26 can be put on the handle 12 without any pretreating process as desired. Further, as discussed above, the blasting process can be performed to only portions of the handle 12.

In an alternative embodiment, the coating 26 provides a sticky or tacky feel for providing the player with tactile feedback as to the orientation of the lacrosse head 18. In another embodiment, the pretreatment provides the handle 12 with a tacky feel and the coating 26 provides strength and durability to the handle 12. It will be understood that the tacky feel for the handle 12 may result from the pretreatment process or the coating 26 itself.

Also, as shown in FIG. 2, the tubular member 14 further includes a top half 30 and a bottom half 32, which are separated by a lateral plane 31 and extend between the top end 16 and the bottom end 20. In accordance with the invention, the top half 30 has more of the coating 26 coupled thereto than the bottom half 32. In this way, the handle 12 provides tactile stimuli as to the orientation of the lacrosse stick 10 within the player's hands. Thus, a player can quickly sense how to carry and/or manipulate the lacrosse stick without even looking at the lacrosse stick 10. It is contemplated that various amounts of the coating 26 can be applied to various portions of the tubular member 14. For example, the coating 26 can be applied to the entire top half 30 or enough of the top half 30 to provide the tactile stimuli effect. It will be understood that the top half 30 and the bottom half 32 may be interchanged such that the coating 26 is applied to the bottom half 32.

Figure 5:
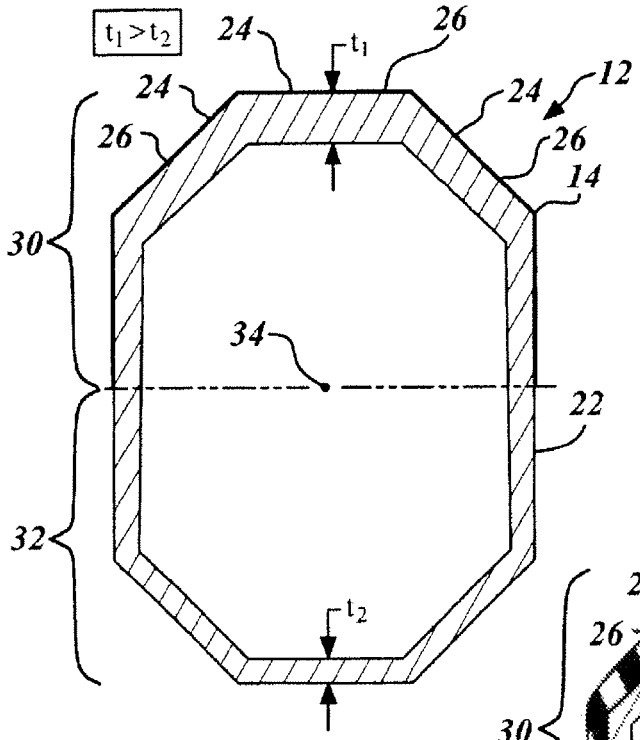
FIG. 5 is a cross-sectional view of the improved handle shown in FIG. 2, according to another advantageous embodiments of the claimed invention.

In another embodiment shown in FIG. 5, the tubular member 14 has an eccentric construction for providing the tactile feedback. Specifically, the top half 30 has a sufficiently larger average wall thickness than that of the bottom half 32. In this way, the center of mass of the tubular member 14 is offset from a central longitudinal axis 34 of the tubular member 14. One skilled in the art will appreciate that this construction provides tactile feedback regarding the orientation of the lacrosse stick 10 when the handle 12 is rotated about its longitudinal axis 34, namely when the player cradles a ball in the lacrosse stick 10.

Figure 6:
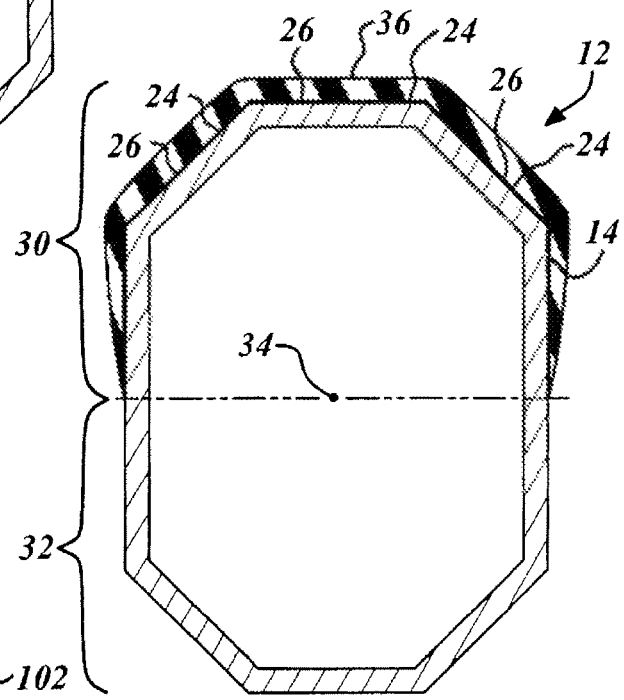
FIG. 6 is a cross-sectional view of the improved handle shown in FIG. 2, according to still another advantageous embodiment of the claimed invention.

Referring now to FIG. 6, there is shown the improved handle 12 of FIG. 2, according to yet another embodiment of the claimed invention. In this embodiment, the handle 12 further includes a no-slip layer 36 coupled to the coating 26. The no-slip layer 36 is beneficial for absorbing the shock that would otherwise be transmitted to the player's hands. This no-slip layer 36 also provides tactile feedback as to the position of the lacrosse stick 10 within the player's hands, which is beneficial for the reasons provided above. In this embodiment, the no-slip layer 36 is a neoprene foam material. However, it is understood that the no-slip layer 36 can instead be comprised of various other suitable materials as desired. It will also be appreciated that the no-slip layer 36 can instead be coupled directly to the tubular member 14 instead of the coating 26 and/or in various other suitable locations on the tubular member 14 as desired. Like the coating 26, the no-slip layer 36 can be disposed on the handle 12 or along the entire outer surface 22. In addition, it is also contemplated that the handle 12 can be provided without the coating 26 such that the no-slip layer 36 is in effect the coating 26.

Figure 7:
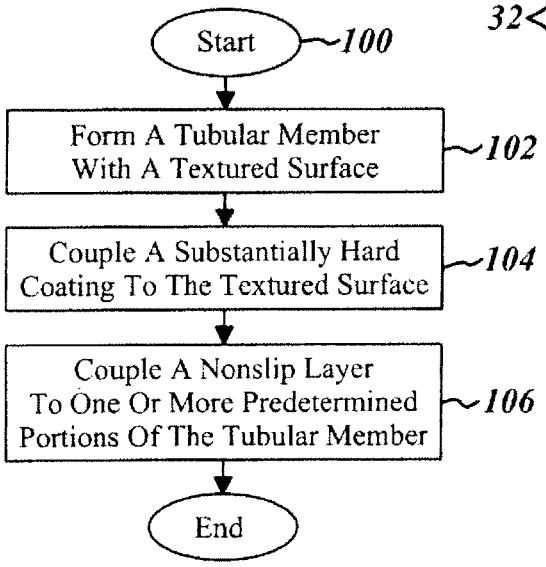
FIG. 7 is a flow diagram of a method for manufacturing the improved handle shown in FIG. 1.

Referring now to FIG. 7, there is shown a logic flow diagram of a method for manufacturing the handle 12 shown in FIG. 1. The method begins in step 100 and then immediately proceeds to step 102.

In step 102, the tubular member 14 is formed from a metal billet. Specifically, the tubular member 14 is formed via an extrusion process and then subjected to a heavy-grit or shot-peen blast process for forming a textured surface 28 on the handle 12. In another embodiment, the tubular member 14 is formed via a tube mill process for producing the eccentric construction with a non-uniform wall thickness. It is understood that the tubular member 14 can be formed of various suitable materials and produced by a variety of manufacturing methods as desired. The sequence then proceeds to step 104. Obviously, other suitable processes may be utilized.

In step 104, the coating 26 is coupled to the textured surfaces 28 of the tubular member 14. This step is accomplished by an anodizing or electroplating process in which the coating 26 becomes an integral part of the tubular member. As detailed hereinabove, the coating 26 is beneficial for strengthening the tubular member 14, minimizing corrosion of the tubular member 14, and decreasing vibrations in the handle 12.

The coating 26 is applied to the top half 30 of the tubular member 14 for providing the additional benefit of tactile stimuli. However, it is understood that the coating 26 can be comprised of various other suitable materials and be coupled to the tubular member 14 via a variety of other manufacturing processes. The sequence then proceeds to step 106.

In step 106, the no-slip layer 36 is coupled to one or more predetermined portions 24 of the tubular member 14. The no-slip layer 36 is beneficial for absorbing shock within the tubular member 14, providing tactile stimuli regarding the orientation of the lacrosse stick 10, and strengthening the tubular member 14. The no-slip layer 36 may be applied to the tubular member 14 without any pretreatment.

In this embodiment, the no-slip layer 36 is a neoprene foam material coupled to the coating 26. However, it will be appreciated that the no-slip layer 36 can instead be comprised of various other suitable materials and coupled to a variety of other portions of the tubular member 14 as desired.

While particular embodiments of the invention have been shown and described, numerous variations and alternate embodiments will occur to those skilled in the art. Accordingly, it is intended that the invention be limited only in terms of the appended claims.

What is claimed is:

1. A handle for a lacrosse stick, comprising:

a tubular member having a polygonal cross section and a top end for attachment to a lacrosse head and a bottom end that is opposite to said top end, said tubular member having an outer surface, said polygonal cross section including a top half having a first wall thickness and a bottom half having a second wall thickness, said top half delineated from said bottom half by a plane extending through an axis of the tubular member;

a coating coupled to at least one predetermined portion of said outer surface for strengthening said tubular member, preventing damage thereto, and decreasing vibration therein; and a no-slip layer joined with at least one of said coating and said outer surface, said no-slip layer partially circumferentiating said tubular member, said no-slip layer including a first end and a second end, each of said first and second ends tapering from a first thickness to a lesser thickness where the no-slip layer approaches the plane extending through the axis of the tubular member, each of said first and second ends terminating at a first and second lateral edges near said lateral plane;

said tubular member having an eccentric construction so that a center of mass of said tubular member is offset from said plane, said eccentric construction created by a difference in said first wall thickness relative to said second wall thickness for providing tactile feedback as to the orientation of said top half and said bottom half of the lacrosse stick in a player's hand.

2. The handle recited in claim 1 wherein said coating is an oxide layer that is coupled to said at least one predetermined portion of said outer surface via an anodization process.

3. The handle recited in claim 1 wherein said polygon cross section is an octagon, wherein said no-slip layer is applied to at least five sides of the tubular member, wherein said first and second ends cover only a portion of first and second sides with which the first and second ends are joined so that remaining portions of the first and second sides remain uncovered by the no-slip layer.

4. The handle recited in claim 1 wherein the size and shape of said eccentric construction of said tubular member substantially retains a similar size and shape from said top end to said bottom end of said lacrosse handle.

5. The handle of claim 1, wherein said first wall thickness is greater than said second wall thickness.

6. The handle recited in claim 1 wherein said coating is an overmolded layer on said tubular member.

7. A handle for a lacrosse stick, comprising:

a tubular member having a polygonal cross section and a top end for attachment to a lacrosse head and a bottom end that is opposite to said top end, said tubular member having an outer surface, said polygonal cross section including a top portion having a first plurality of walls joined at a first plurality corners, the first walls and first corners being of a first uniform thickness and a bottom portion having a second plurality of walls joined to a second plurality of corners, the second walls and second corners being of a second uniform thickness, that is greater than the first uniform thickness, said top portion delineated from said bottom portion by a plane; and a coating coupled to said outer surface of at least one of said top portion and said bottom portion of said tubular member for strengthening said tubular member, preventing damage thereto, and decreasing vibration therein;

wherein said tubular member has an eccentric construction so that a center of mass of said tubular member is offset from said plane, said eccentric construction created by the difference in said first uniform thickness relative to said second uniform thickness for providing tactile feedback as to the orientation of said top portion and said bottom portion of the lacrosse stick in a player's hand.

8. The handle recited in claim 7 comprising a no-slip layer coupled to said tubular member for further strengthening said tubular member, preventing damage thereto, absorbing shock transmitted therethrough, and providing tactile feedback as to the orientation of the lacrosse stick in the player's hand, said no-slip layer circumferentiating only a portion of said tubular member, said no-slip layer terminating at ends that taper from one thickness to a lesser thickness as the ends approach said plane.

9. The handle recited in claim 8 wherein said no-slip layer is a neoprene foam material.

10. The handle recited in claim 7 wherein said coating is an oxide layer that is coupled to said outer surface via an anodization process.

11. The handle recited in claim 10 wherein said polygon cross section is an octagon, wherein said no-slip layer is applied to at least five sides of the tubular member, wherein said first and second ends cover only a portion of first and second sides with which the first and second ends are joined so that remaining portions of the first and second sides remain uncovered by the no-slip layer.

12. The handle recited in claim 7 wherein the size and shape of said eccentric construction of said tubular member substantially retains a similar size and shape from said top end to said bottom end of said lacrosse handle.

13. The handle of claim 8, wherein said first uniform thickness is greater than said second uniform thickness.

14. A handle for a lacrosse stick, comprising:

an elongate tubular shaft having a polygonal cross section with two sides of greater length than the remaining sides of the polygonal cross section, the shaft including a top end adapted to attach to a lacrosse head and a bottom end, opposite the top end, the tubular shaft including an outer surface, the tubular shaft defining a longitudinal axis, the tubular shaft including a top portion and a bottom portion delineated from one another by a plane that is transverse to the two sides of greater length of the polygonal cross section, the plane passing through the longitudinal axis, a coating joined with the outer surface of the tubular shaft for strengthening said tubular member, preventing damage thereto, and decreasing vibration therein; and a no-slip layer joined with at least one of the outer surface and the coating, the no-slip layer adapted to further strengthen the tubular shaft, to prevent damage thereto, to absorb shock transmitted therethrough, and to provide tactile feedback as to the orientation of the lacrosse stick in the player's hand, wherein the no-slip layer only partially circumferentiates the tubular shaft, so that at least a portion of the tubular shaft remains uncovered by the no-slip layer, wherein the no-slip layer includes a first end and a second end, the first end terminating adjacent one of the two sides of greater length of the polygonal cross section, and the second end terminating adjacent the other of the two sides of greater length of the polygonal cross section, wherein the no-slip layer tapers from a first thickness to a second thickness, lesser than the first thickness near the first and second ends, wherein the no-slip layer provides weight sufficient to offset a center of mass of the tubular shaft from the longitudinal axis, thereby providing tactile feedback as to the orientation of the top portion and the bottom portion of the lacrosse stick in a player's hand; wherein said tubular member having an eccentric construction so that a center of mass of said tubular member is offset from said plane, said eccentric construction created by a difference in said first wall thickness relative to said second wall thickness.

15. A handle for a lacrosse stick, comprising:

an elongate tubular shaft having a polygonal cross section, the shaft including a top end adapted to attach to a lacrosse head and a bottom end, opposite the top end, the tubular shaft including an outer surface, the tubular shaft defining a longitudinal axis, the tubular shaft including a top portion and a bottom portion delineated from one another by a plane that passes through the longitudinal axis; and a no-slip layer joined with the tubular shaft, the no-slip layer adapted to strengthen the tubular shaft, to prevent damage thereto, to absorb shock transmitted therethrough, and to provide tactile feedback as to the orientation of the lacrosse stick in the player's hand, wherein the no-slip layer is joined with the top portion of the tubular shaft, with the bottom portion being uncovered by the no-slip layer, wherein the no-slip layer includes a first end and a second end, distal from the first end, the no-slip layer terminating at the first end and the second end, wherein the no-slip layer tapers from a first thickness to a second thickness, lesser than the first thickness adjacent the first and second ends, wherein the no-slip layer provides weight sufficient to offset a center of mass of the tubular shaft from the longitudinal axis, thereby providing tactile feedback as to the orientation of the top portion and the bottom portion of the lacrosse stick in a player's hand; wherein said tubular member having an eccentric construction so that a center of mass of said tubular member is offset from said plane, said eccentric construction created by a difference in said first wall thickness relative to said second wall thickness.

* * * * *